US005126887A

United States Patent [19]

Sprafke

[11] Patent Number: 5,126,887

[45] Date of Patent: Jun. 30, 1992

[54] CAP FOR PROTECTING THE OCULAR OF A PERISCOPE ON A COMBAT VEHICLE

[75] Inventor: Uwe Sprafke, Schauenburg, Fed. Rep. of Germany

[73] Assignee: Wegmann & Co. GmbH, Kassel, Fed. Rep. of Germany

[21] Appl. No.: 696,813

[22] Filed: May 7, 1991

[30] Foreign Application Priority Data

May 18, 1990 [DE] Fed. Rep. of Germany ..... 4016074

[51] Int. Cl.[5] ..... G02B 27/00

[52] U.S. Cl. ..... 359/894; 359/402; 359/408; 2/6; 2/410; 2/424

[58] Field of Search ..... 359/894, 817, 402, 408; 2/6, 9, 10, 12, 13, 410, 424

[56] References Cited

U.S. PATENT DOCUMENTS

| | | | |
|---|---|---|---|
| 4,059,347 | 11/1977 | Eitel | 359/894 |
| 4,495,657 | 1/1985 | Bay | 2/424 |
| 4,846,553 | 7/1989 | Rice | 359/408 |
| 4,920,585 | 5/1990 | Arai et al. | 2/424 |
| 4,922,550 | 5/1990 | Verona et al. | 2/6 |
| 4,981,346 | 1/1991 | Marschner | 359/402 |

*Primary Examiner*—loha Ben

*Attorney, Agent, or Firm*—Sprung Horn Kramer & Woods

[57] ABSTRACT

A protective cap for the ocular of a periscope in a combat vehicle. A wrapping encloses expanded plastic and leaves a viewing cutout uncovered. Controls and/or electrical equipment are integrated into the wrapping in order to save space inside the vehicle.

6 Claims, 3 Drawing Sheets

CAP FOR PROTECTING THE OCULAR OF A PERISCOPE ON A COMBAT VEHICLE

BACKGROUND OF THE INVENTION

The invention concerns a cap for protecting the ocular of a periscope in a combat vehicle, with a wrapping that encloses expanded plastic and leaves a viewing cutout uncovered.

Protective caps of this type, one embodiment of which will be specified later herein by way of example, are in themselves known. The ocular extends into the cramped interior of the vehicle, and the cap is intended to prevent it from becoming damaged or injuring the crew. Such caps are accordingly generally upholstered with soft expanded plastic. The drawback that the cap's relatively thick upholstering additionally reduces the already restricted space inside the vehicle must be taken into account.

SUMMARY OF THE INVENTION

The object of the present invention is to improve a protective cap of the aforesaid type by saving as much utilizable space inside the vehicle as possible while creating additional space for controls.

This object is attained in accordance with the invention in that controls and/or electrical equipment are integrated into the wrapping. It has been proved practical for the controls and/or equipment to be integrated into the areas of the wrapping immediately adjacent to the viewing cutout. The controls and/or equipment can be accommodated in areas of the wrapping integrated into the main area of the wrapping, which surrounds the ocular. They can, however, also be accommodated in areas of the wrapping that separate from the main area, which surrounds the ocular. Additional electrical equipment can even be accommodated in the side of the wrapping that faces away from the viewing cutout.

The basis principle of the invention is that components of the controls and electrical equipment that are needed in a combat vehicle, in conjunction with optical equipment for example, can be integrated into the upholstered cap so that at least some of the space already occupied by the cap can be exploited for other purposes, alleviating through an ergonomically meaningful approach the shortage of space in the vicinity of the operators of the combat vehicle. It makes sense to accommodate the controls in areas of the cap that are particularly accessible, and electrical equipment, integrated circuits for example, in other areas that are not as accessible, at the rear for example. Especially preferred for accommodating controls are the edges of the cap's viewing cutout, and a directional orientation (right and left) in an area that is easy for the operator to see entails particular advantages.

Those areas of the cap that have controls and/or electric equipment integrated into them can either be integrated into the rest of the cap, meaning that the cap will be molded along with the desired components, or constitute separate areas that attach to the main area of the cap with snap fasteners for example, allowing different types of component to be installed.

The controls and/or equipment can also snap directly into the cap to facilitate replacement.

A known cap and an embodiment of a cap in accordance with the invention will now be specified with reference to the attached drawings.

DETAILED DESCRIPTION OF THE INVENTION

Figure 1:
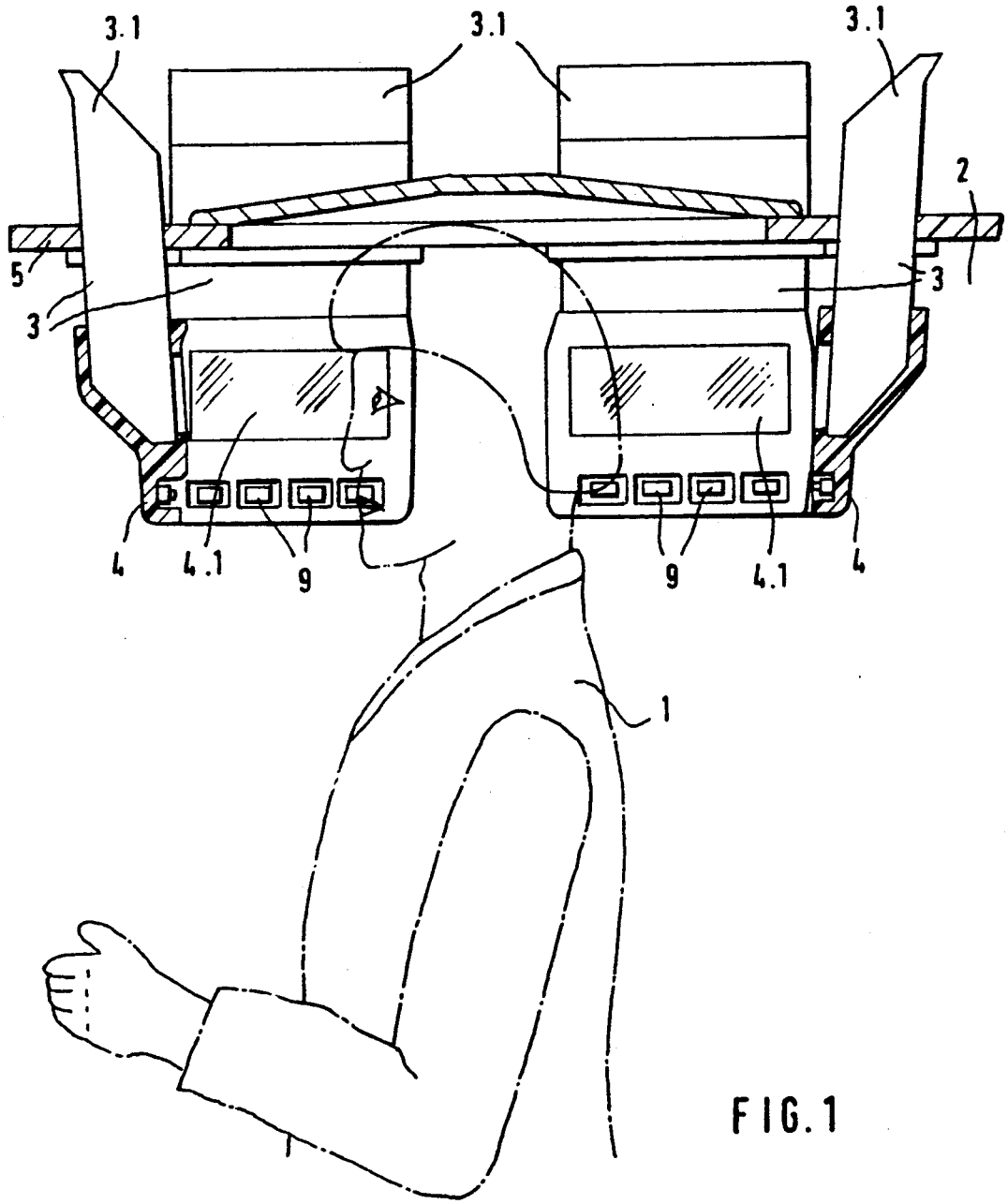
FIG. 1 is a highly simplified section through part of a combat vehicle in the vicinity of the periscope.

FIG. 1 represents the conventional distribution of several periscopes in a combat vehicle. The periscopes extend through the roof 5 of the vehicle with their objectives 3.1 outside and their oculars 3 extending into the interior 2 far enough for an operator 1 to see into them. To prevent damage to ocular 3 or injury to operator 1, each ocular has a protective cap 4 with a viewing cutout 4.1 on one side.

Figure 2:
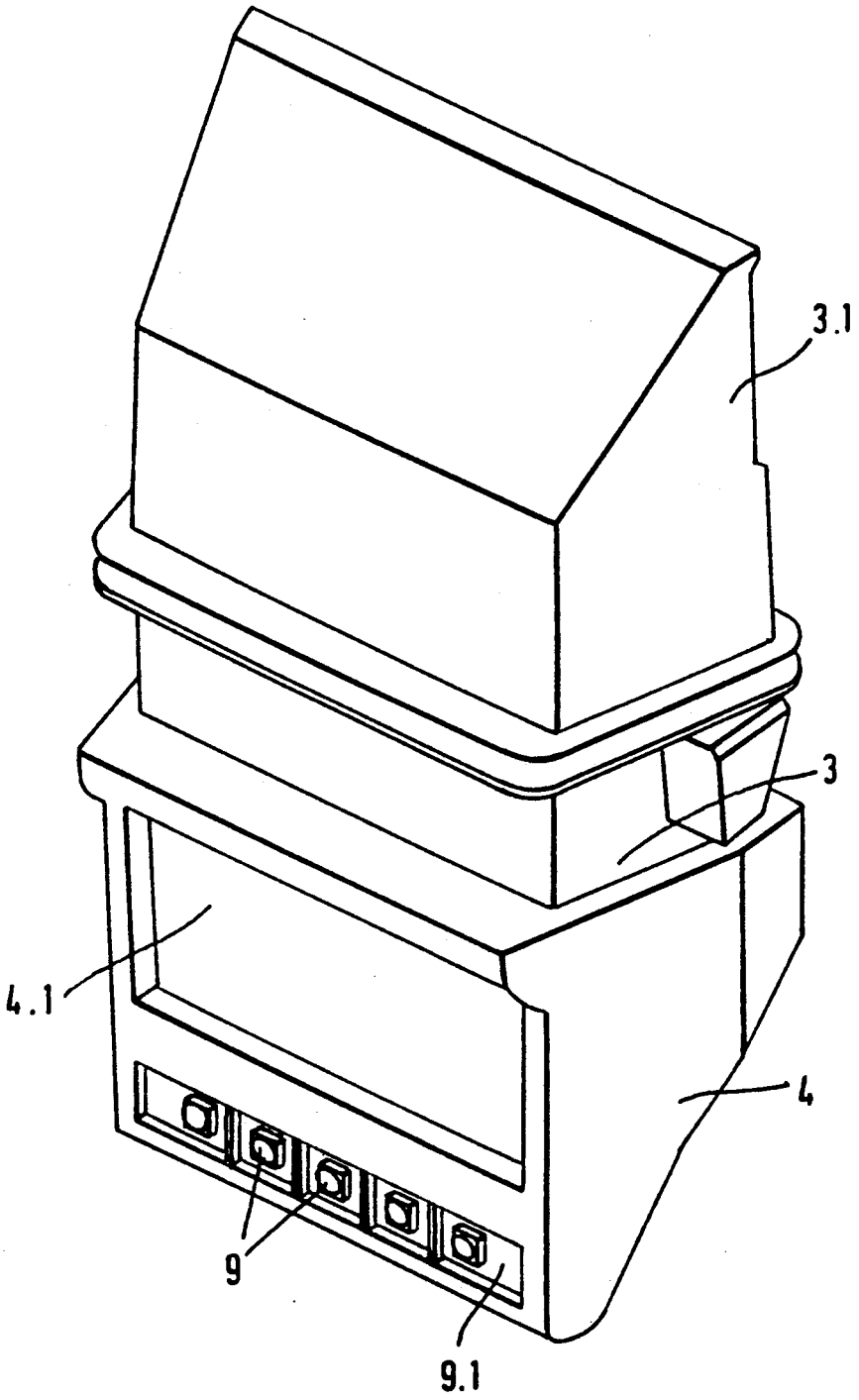
FIG. 2 is a perspective rendering of part of a periscope with a protective cap in accordance with one embodiment of the invention.

FIG. 2 is a more detailed representation of an ocular 3 with a protective cap 4. Cap 4 surrounds the bottom and all four sides of ocular 3 and contains soft expanded-plastic upholstering inside a wrapping.

Accommodated in a depression 9.1 in the bottom edge of the front of the protective cap 4 illustrated in FIGS. 1 and 2 are controls 9 for electrical equipment that will be neither specified nor illustrated herein.

Figure 3:
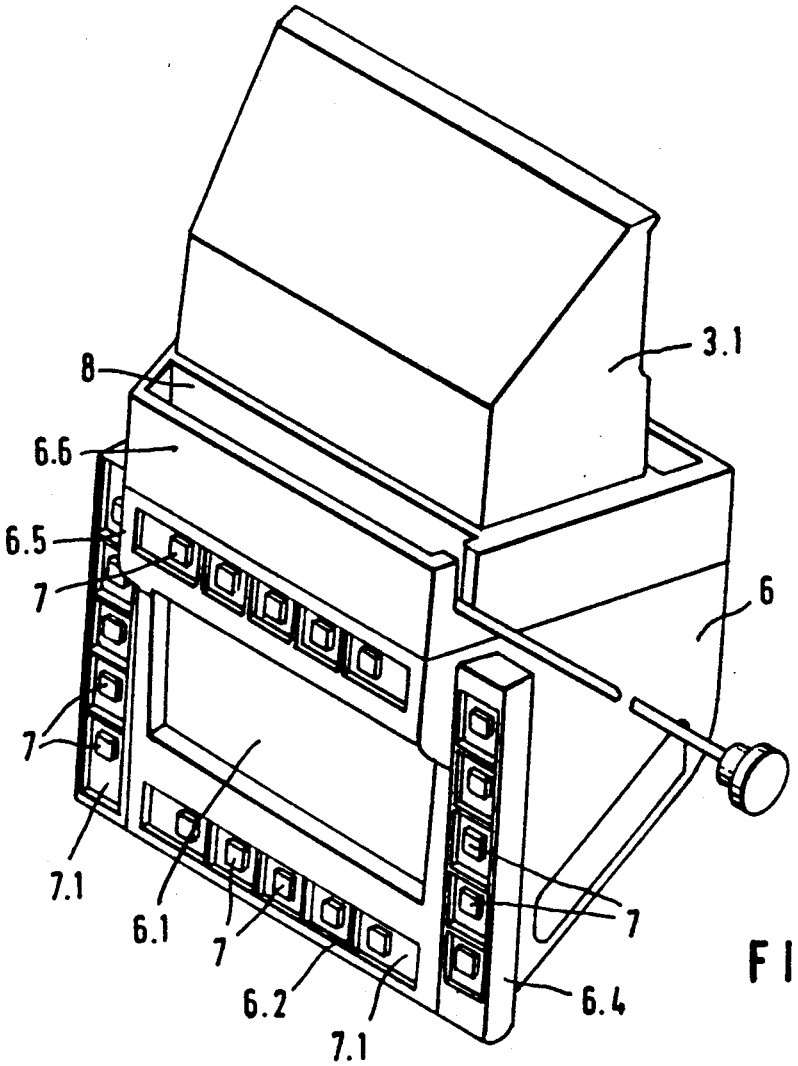
FIG. 3 is a view similar to that in FIG. 2 of a periscope with a protective cap in accordance with another embodiment of the invention.
Figure 4:
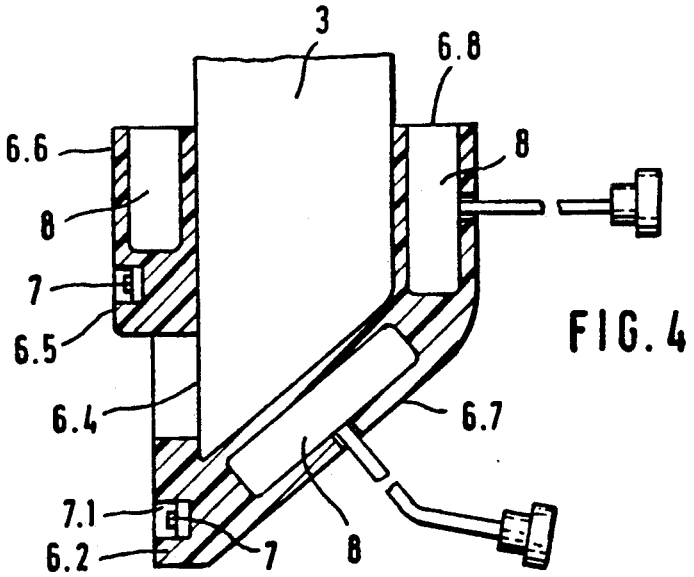
FIG. 4 is a vertical section through the protective cap illustrated in FIG. 3 along with its ocular.

FIGS. 3 and 4 illustrate how such protective cap can be exploited to accommodate even more controls and/or electrical equipment.

The ocular 3 illustrated in FIGS. 3 and 4 is surrounded by a protective cap 6 that is similar in principle to the ca 4 illustrated in FIG. 2.

Controls 7 for electric equipment are accommodated as illustrated in FIG. 3 in depressions 7.1 in areas 6.2, 6.3, 6.4, and 6.5 in the immediate vicinity of the viewing cutout 6.1 in cap 6. Additional areas on the front 6.6, rear 6.8, and bottom 6.7 of the cap accommodate other controls, and electrical equipment 8, circuit boards for example, is integrated into the upholstery.

The areas of protective cap 6 that have controls and/or equipment integrated into them can be secured in an unillustrated way to the cap's main area with snap fasteners and can accordingly be separated therefrom.

What is claimed is:

1. A protective cap for the ocular of a periscope for a combat vehicle, comprising: a wrapping that encloses expanded plastic and leaves a viewing cutout uncovered, wherein controls and/or electrical equipment are integrated into the wrapping.

2. A protective cap as in claim 1, wherein the controls and/or equipment are integrated into areas of the wrapping immediately adjacent to the viewing cutout.

3. A protective cap as in claim 1, wherein the controls and/or equipment are accommodated in areas of the wrapping integrated into a main area of the wrapping which surrounds the ocular.

4. A protective cap as in claim 1, wherein the controls and/or equipment are accommodated in areas of the wrapping that are separate from a main area which surrounds the ocular.

5. A protective cap as in claim 1, further comprising additional electrical equipment accommodated in a side of the wrapping that faces away from the viewing cutout.

6. A protective cap as in claim 1, wherein the controls and/or electrical equipment snap into areas of the wrapping that they are integrated into.

* * * * *